United States Patent [19]

Tagawa et al.

[11] Patent Number: 4,835,571

[45] Date of Patent: May 30, 1989

[54] CORONA DISCHARGING UNIT FOR USE IN COPYING MACHINE

[75] Inventors: Takao Tagawa, Kashihara; Etsuzi Nukushina, Nara; Yoshiyuki Nakai, Yamatokoriyama, all of Japan

[73] Assignee: Sharp Kabushiki Kaisha, Osaka, Japan

[21] Appl. No.: 147,434

[22] Filed: Jan. 25, 1988

Related U.S. Application Data

[63] Continuation of Ser. No. 22,493, Mar. 9, 1987, abandoned, which is a continuation of Ser. No. 697,224, Jan. 31, 1985, abandoned.

[30] Foreign Application Priority Data

| | | | |
|---|---|---|---|
| Jan. 31, 1984 | [JP] | Japan | 59-17397 |
| Feb. 13, 1984 | [JP] | Japan | 59-26269 |
| Feb. 14, 1984 | [JP] | Japan | 59-27867 |
| Feb. 15, 1984 | [JP] | Japan | 59-27614 |

[51] Int. Cl.[4] ..... G03G 15/02

[52] U.S. Cl. ..... 355/225; 355/274; 355/276; 355/315

[58] Field of Search ..... 355/3 CH, 14 CH; 250/324–326

[56] References Cited

U.S. PATENT DOCUMENTS

| | | | |
|---|---|---|---|
| 4,141,648 | 2/1979 | Gaitten et al. | 355/3 CH |
| 4,183,653 | 1/1980 | Satomi et al. | 355/3 CH |
| 4,400,081 | 8/1983 | Yamashita et al. | 355/3 CH |
| 4,408,865 | 10/1983 | Camis et al. | 355/3 CH |

*Primary Examiner*—R. L. Moses

*Attorney, Agent, or Firm*—Flehr, Hohbach, Test, Albritton & Herbert

[57] ABSTRACT

A corona discharging unit comprises a control grid to which a diode is attached and a high voltage AC power is applied to its discharge line. A single unit of this design with a single power source, when used in an electrophotographic copying machine with a rotating photosensitive drum, can perform more than one of the functions required in a copying process such as preliminary charging of the drum, transferring images, discharging and cleaning.

8 Claims, 6 Drawing Sheets

CORONA DISCHARGING UNIT FOR USE IN COPYING MACHINE

This is a continuation of application Ser. No. 022,493 filed 3-9-87 abandoned which is a continuation of application Ser. No. 697,224 filed 1-31-9185 abandoned.

BACKGROUND OF THE INVENTION

This invention relates to an improved corona discharging unit used, for example, in an electrophotographic copying machine and also an electrophotographic copying machine which incorporates such improved corona discharging unit.

As shown in FIG. 1, a corona discharging unit of conventional design used, for example, in an electrophotographic copying machine contains a corona discharge line 2 inside a grounded shield case 1 and a high voltage power source 3 is connected to this corona discharge line to effect positive, negative or AC discharge, depending upon the purpose. A screen grid 4 may be installed at the opening of the discharging unit (shield case 1) as shown in FIG. 2 so that the output can be controlled by means of a source 3 connected to the screen grid 4.

When discharges of different polarities are required, however, it is not sufficient to have a single unit of the conventional type described above. Moreover, high voltage power sources corresponding to the individual polarities (positive, negative, and AC) become necessary.

It is therefore an object of the present invention in view of the above to provide a corona discharging unit which can utilize the discharging means for charging, transferring and discharging (AC or DC) in a copying process.

It is another object of the present invention to provide an electrophotographic copying machine which eliminates the drawbacks of the conventional devices described above by unitizing a discharging unit for transferring and another unit for discharging so that a single high voltage power source can perform two functions.

It is still a further object of the present invention to provide a small, light-weight, inexpensive electrophotographic recording machine with a simplified structure by using some of the components for more than one purpose.

In order to achieve the aforementioned objectives, the corona discharging unit for use in a copying machine according to the present invention comprises a shield case, a corona discharge line installed inside this shield case, a control grid disposed in the vicinity of the opening section of the shield case for controlling the polarity and/or output of the corona discharge, a control means connected to the control grid for controlling the polarity and/or output of the corona discharge, and a high voltage AC power source connected to the aforementioned corona discharge line.

According to an embodiment of the present invention, an electrophotographic copying machine causes copy paper to contact a photosensitive means on which a toner image is formed and copying is effected by means of a corona discharging unit which comprises a single corona discharger and a single high-voltage power source. Transferring of the toner image as well as separation of the copy paper from the photosensitive means are also effected by means of this corona discharging unit.

According to another embodiment of the present invention, the electrophotographic copying machine is adapted for functions such as charging, image exposure, development, transferring, discharging and cleaning. During its operation in Mode 1, the photosensitive means is charged prior to its exposure to light and the toner image formed thereon is transferred in the Mode 2 operation. For this purpose, a corona discharging unit disposed opposite to this photosensitive means is provided with a means for selectively assigning its functions to Mode 1 and Mode 2.

DETAILED DESCRIPTION OF THE INVENTION

Figure 3:
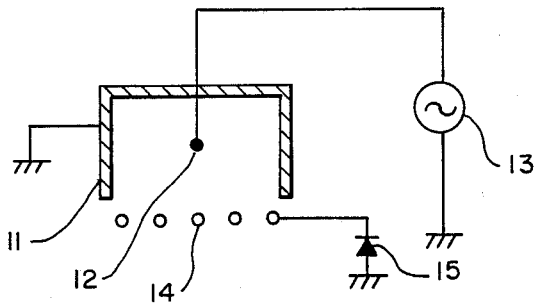
FIG. 3 shows the structure of a corona discharging unit according to an embodiment of the present invention.

There is shown in FIG. 3 the structure of a corona discharging unit according to an embodiment of the present invention. No. 11 is a shield case made of a metallic material such as aluminum and adapted to be electrically grounded when in use. No. 12 is a corona discharge line made, for example, of tungsten and is disposed at the center of the shield case 11. No. 13 is a high-voltage AC power source connected to the corona discharge line 12. No. 14 is a control grid disposed at the opening part of the shield case 11. More in detail, it is made of a metallic material such as stainless steel or aluminum, and is attached t the shield case 11 through an insulating means (not shown). No. 15 is a control means for controlling the polarity, output, etc. of the corona discharging and is connected to the control grid 14. In this example, a diode is used as the simplest example of the control means 15.

Figure 1:
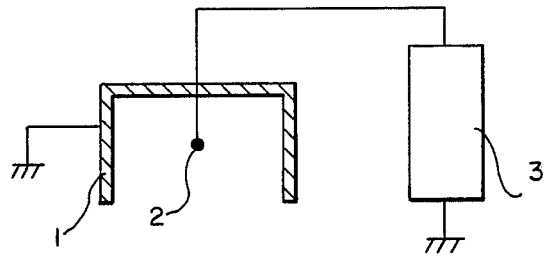
PRIOR ART FIG. —1
FIGS. 1 and 2 show the structure of a conventional corona discharging unit.
Figure 2:
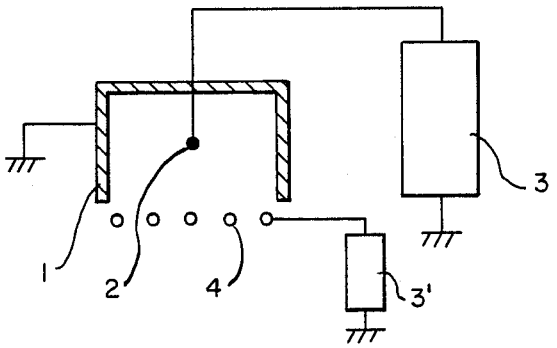
PRIOR ART FIG. —2

One of the electrodes of the diode which functions as the control means 15 is connected to the control grid 14 while the other electrode is grounded. When positive corona discharge is desired, it is the anode of the diode 15 that is grounded as shown in FIG. 1 while the cathode is connected to the control grid 14. When negative corona discharge is necessary, on the other hand, the connection is reversed from the disclosure of FIG. 1; the anode of the diode 15 is connected to the control grid 14 and the cathode is grounded. Any other method may be used for the selection of polarity, depending on the situation. AC corona may be utilized as effective corona, or an external selection switch or an external signal may be used instead.

Regarding the structure shown in FIG. 3, the AC corona generated from the line 12 connected to the high voltage AC power source 18 leaks to the ground in accordance with the phase of the power source. In other words, it leaks to the grounded side through the control grid 14 and the diode 15 during the negative phase while the effective corona becomes positive during the positive phase. When negative corona discharge is necessary as effective corona, on the other hand, it can be achieved by reversing the polarity of the diode 15 so that the positive corona will leak to the grounded side.

Thus, according to the example of FIG. 3, the polarity of corona discharge can be controlled basically by changing the direction in which the positive and negative electrodes of the diode 15 are connected to the control grid 15. Corona discharge of unwanted polarity is thus branched into the grounded side of the control grid 14 and the polarity of the effective corona can be controlled freely.

Figure 4:
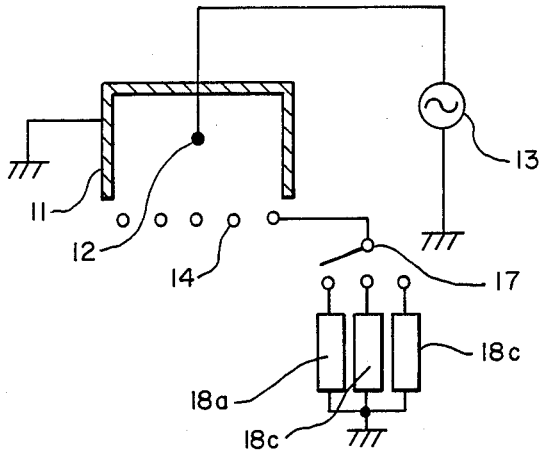
FIGS. 4, 5 and 6 show the structure of corona discharging units according to other embodiments of the present invention.

Another embodiment of the present invention is shown in FIG. 4 wherein the control grid 14 is connected to a selecting means 17 so that its control mode can be selected whenever necessary by means of an external switch or a status signal.

By this example, a control means 18A is selected by the selecting means 17 when positive corona discharge is necessary so that negative corona discharge which is not wanted will leak through to the grounded side. If negative corona discharge is necessary, on the other hand, another control means 18B is selected by the selecting means 17 so that positive discharge which is not wanted will leak through to the grounded side. If AC corona discharge is necessary, a third control means 18C is selected by the selecting means 17 and a predetermined bias potential is applied to the control grid. A corona discharging unit having different functions can thus be obtained.

Figure 5:
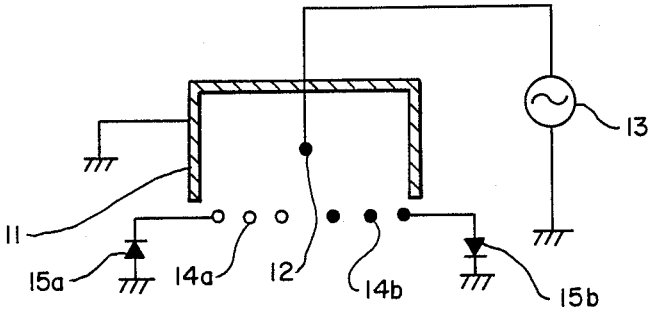
Figure 6:
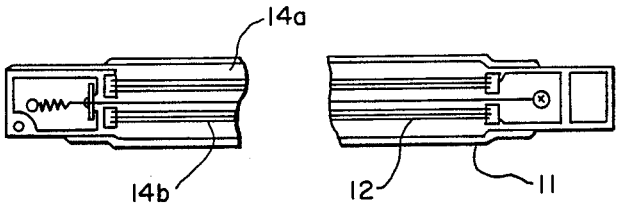

Still different embodiments of the present invention are shown in FIGS. 5 and 6 wherein the control grid 14 of FIGS. 3 and 4 is divided into two parts 14A and 14B which are mutually insulated form each other and independently connected to control means 15A and 15B having different functions. In particular, FIG. 5 shows that the control grid 14A is connected to the cathode of the diode 15A of which the anode is grounded while the control grid 14B is connected to the anode of the diode 15B of which the cathode is grounded. Thus, the section covered by the control grid 14A functions as a positively chargeable body while that by the control grid 14B functions as a negatively chargeable body. In the case of a transfer-type copying machine requiring two chargeable bodies for the transferring after the formation of a toner image and for the discharging to separate transfer paper, for example, these two can be combined into a single means having two functions.

Although there was shown in the above an example of polarity control by means of a single diode of the simplest kind, the present invention is not intended to be limited by this example. If necessary, the control means to be connected to the control grid may include a power source, resistors, etc. and may be so constructed to control also the output of the discharging unit. Alternatively, the control means may be a mere grounding means by which AC output control can be selected. As for the control grid, a parallel grid of 100-micron stainless wires is disclosed for this example but it goes without saying that this may be replaced by a metallic plate or a metallic net. Although FIGS. 5 and 6 show the control grid 14 divided into two segments, this again does not limit the present invention; it may be divided into more segments. Although FIG. 5 shows the division in a cross-sectionally lateral direction, the division may also be made in the longitudinal direction.

In summary, since the corona discharging unit of the present invention comprises a shield case, a corona discharge line disposed in this shield case, a control grid disposed near the opening of this shield case, a control means connected to this control grid and a high voltage AC power source connected to the corona discharge line, not only can its output be changed but also its polarity can be easily switched so that a single unit can be used for positive, negative and AC discharging. Moreover, if the control grid is divided so that the divided segments can be separately controlled, the functions of AC and positive corona discharge, for example, can be played by a single unit.

Figure 7:
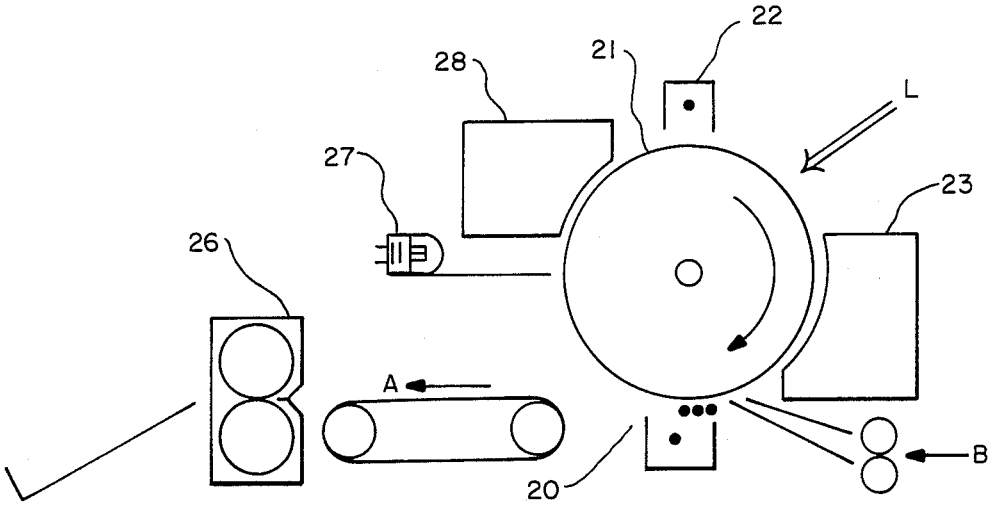
FIG. 7 shows schematically the structure of an example of electrophotographic copying machine which makes use of a corona discharging unit of the present invention.

The structure of an electrophotographic copying machine incorporating a corona discharging unit of the present invention is schematically illustrated in FIG. 7 wherein a photosensitive drum 21 is supported by an axis 29 so that it can rotate in the direction shown by the arrow. This drum 21 becomes uniformly charged by the corona discharging unit 22 and is then exposed to a light image L (or laser light modulated by a recording signal) by an exposing means (not shown), a latent electrostatic image being thereby formed on the drum 21. In the next step, this latent image formed on the drum 21 is developed in the development section 23 by the color toner particles and a toner image is formed on the drum 21. The drum 21 further keeps turning and comes into contact with copy paper (not shown) fed from a paper cassette (not shown) in the direction from A to B where another corona discharging unit 20 is disposed for transferring (or copying) and separating.

At this position for transferring and separating, a corona discharge with opposite polarity to the toner charge is effected from the back surface of the paper by means of the corona discharging unit 20 which unitizes the functions of transferring and separating. The toner image is thereby transferred to the paper; the paper is then separated from the drum 21 by the same corona discharging unit 20 and is moved to the fixing section 26.

Figure 8:
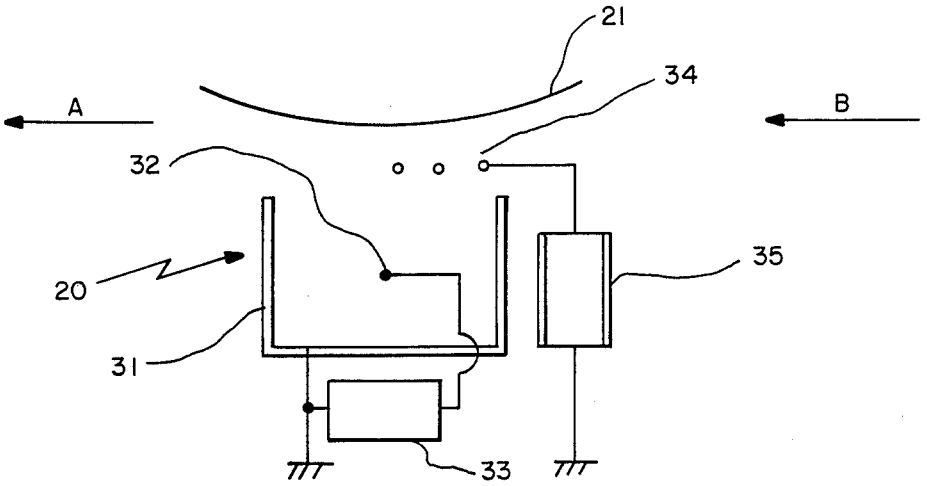
FIG. 8 shows an enlarged view of the transferring means of the machine shown in FIG. 7.

FIG. 8 shows in an enlarged form a portion of FIG. 7 where transferring and separation of paper take place by the unit 20 unitizing these functions. This corona discharging unit 20 is structured as shown in FIG. 3, comprising a shield case 31, a corona discharge line 32 disposed at the center of this shield case 31, a high voltage AC power source 33 connected to this line 32, a control grid 34 disposed near the opening of the shield case 31 so as to cover the upstream half of the opening with respect to the direction of the drum 21 and a control means 35 which is connected to the control grid 34 and controls the corona discharge onto the backside of the copy paper.

Figure 9:
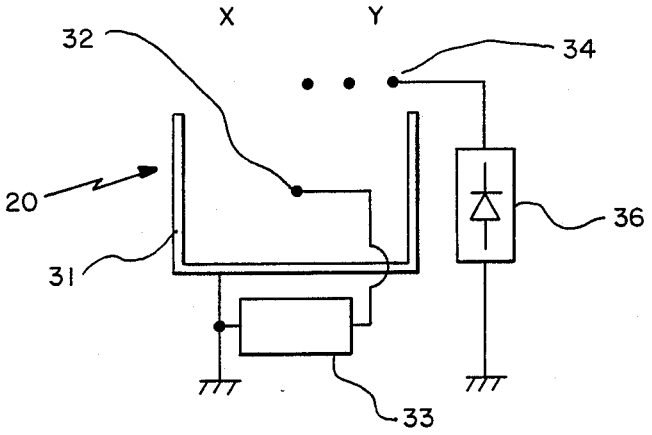
FIG. 9 shows the structure of a corona discharging unit used in the present invention.

A simple example of the control means 35 is shown in FIG. 9 wherein use is made of a rectifier 36. When the paper supplied from B as shown in FIG. 8 comes into contact with a toner image formed on the drum 21, the corona discharging unit 20 operates to transfer the toner image onto the paper in the upstream half Y of the opening. In other words, of the positive and negative charges generated by the discharging from the line 32 connected to the high voltage AC power source 33, those having the same polarity as the charges of the toner leak out to the grounded side through the rectifier 36 while those charges having the opposite polarity effectively operate on the backside of the paper, creating an electric field effective for the transfer.

If the latent electrostatic image is positively charged and the toner particles are negatively charged, for example, the cathode of the rectifier 36 is connected to the control grid 34 and its anode is grounded, so that the negative corona discharge will leak to the ground through the control grid 34 and the rectifier 36 while the positive corona discharge alone will form an electric field for effective performance of transfer.

After the transfer, the AC corona discharge generated by the unit 20 operates directly on the back surface of the paper in the downstream half X of the opening of the shield case in FIG. 9. This separates and discharges the paper which is then sent to the next processing.

In short, since the control grid 34 is disposed only in the upstream half Y of the opening, transfer takes place only in this vicinity and the AC corona directly acts on the back surface of the paper in the downstream half X.

Figure 10:
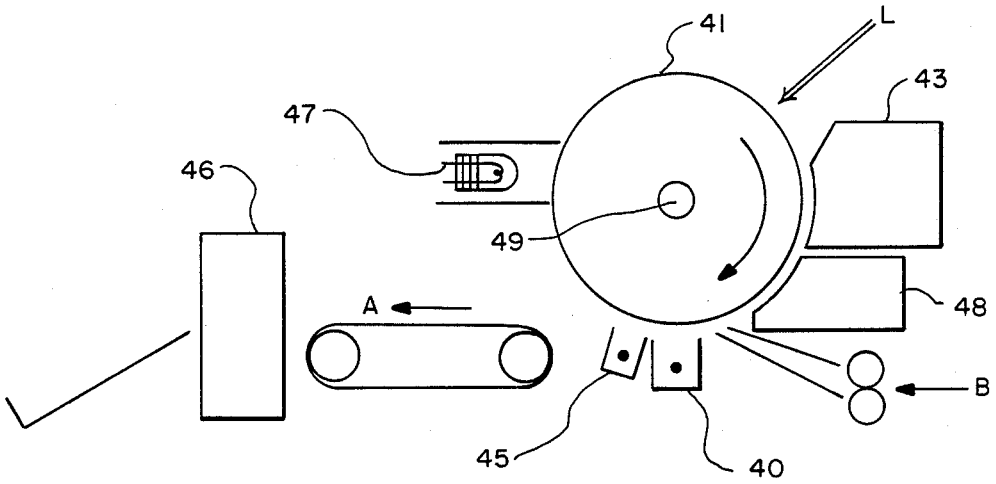
FIG. 10 shows schematically the structure of another example of electrophotographic copying machine which makes use of a corona discharging unit of the present invention.

Another embodiment of electrophotographic copying machine using corona discharging units of the present invention is schematically shown in FIG. 10 wherein a photosensitive drum 41 is a selenium drum built on a conductive base, for example, of aluminum. As in the previous example, this drum 41 is held by an axis 49 and is rotatable in the direction shown by the arrow. during the first rotation (Mode 1), this drum 41 is uniformly (positively, for example) charged by a corona discharging unit 40 which is provided both for this preliminary charging and for transferring. The drum 41 keeps turning and passes an inactive second corona discharging unit 45 which is provided for separating and discharging and then a discharging section 47. Both the second unit 47 and the discharging section 47 are inactive at this moment and there is no effect on the drum 41 from them. When the drum rotates still further and reaches the position for exposure, the light image L of an original is formed on the drum 41 and a latent electrostatic image is formed. Such an image L is obtained by using an exposing means (not shown) to light-scan the original in synchronization with the rotating drum 41. The original may be mounted on a holder means (not shown).

Subsequently, the drum 41 with a latent electrostatic image formed thereon is developed in a development section 43 by means of toner particles which are charged negatively and a toner image of the original is formed on the drum 41. The drum continues to rotate and passes a cleaner means 48. The cleaner means 48, however, is in an inactive condition, for example, by being separated from the drum 41 so that the drum 41 is unaffected and reaches the corona discharging unit 40 again. The drum 41 now starts its second rotation (Mode 2).

During the second rotation, the corona discharging unit 40 is used for transferring (or copying). Copy paper which is passed along in the direction from B to A with proper timing comes into contact with the drum 41 and the toner image is transferred to the paper by corona discharging with positive polarity from the backside of the paper. The paper is thereafter separated from the drum 41 by the other discharging unit 45 (or any other type of separating means) and moves to a fixing section 46. In the meantime, the drum 41 continues to rotate and the residual charges are removed at the discharging section 47 which is now in an active condition. The process of removing residual charges may be effected, if necessary, by means of AC corona discharging or corona discharging of polarity opposite to that of the preliminary uniform charging. The drum 41 rotates still further and the residual toner is removed by the cleaner means 48 which is now in an active condition. This completes one cycle of the copying process and the next cycle is ready to start.

In summary, one cycle according to this embodiment consists of two rotations of the drum 41. During the first rotation, preliminary uniform charging, exposure to light image and development are completed while during the second rotation, transferring of toner image, separation of paper, discharging and cleaning are effected, and the uniform charging during the first rotation and the toner image transfer during the second rotation are both effected by a single corona discharging unit 40 and one high voltage power source.

Figure 11:
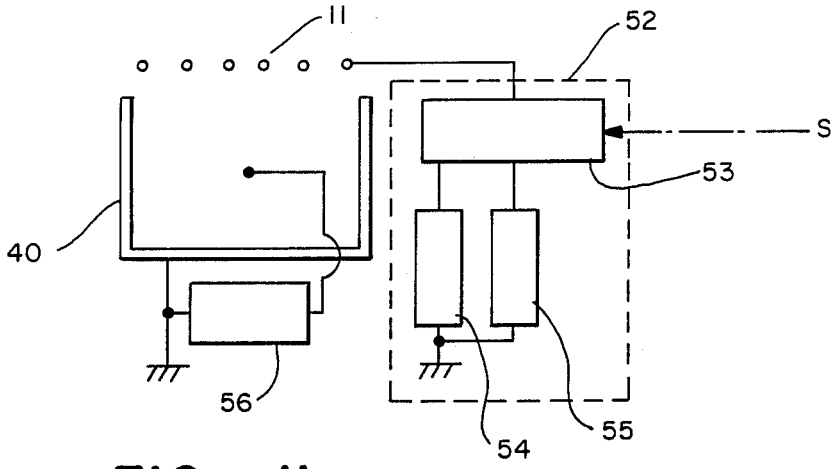
FIG. 11 shows the structure of an example of corona discharging unit for both charging and transferring used in the present invention.

The output from the corona discharging unit 40 is usually higher at the time of the preliminary charging than for the transferring. For this reason, the unit may be so designed that different values of output can be selected for the two occasions. FIG. 11 shows such an example of corona discharging unit 40 to which is connected a selection control means 52 comprising a selection means 53 and control means 54 and 55. When a timing control signal S for distinguishing between the modes is received from a unit control means (not shown), it selects a corona discharge output in accordance with the timing. When a large output is necessary for the preliminary uniform charging, for example, the control grid 51 is grounded through a control means 54 with high resistance while the control grid 51 is grounded through tee other control means 55 with low resistance when a small output is necessary for transferring. No. 56 indicates a high voltage DC power source.

Figure 12:
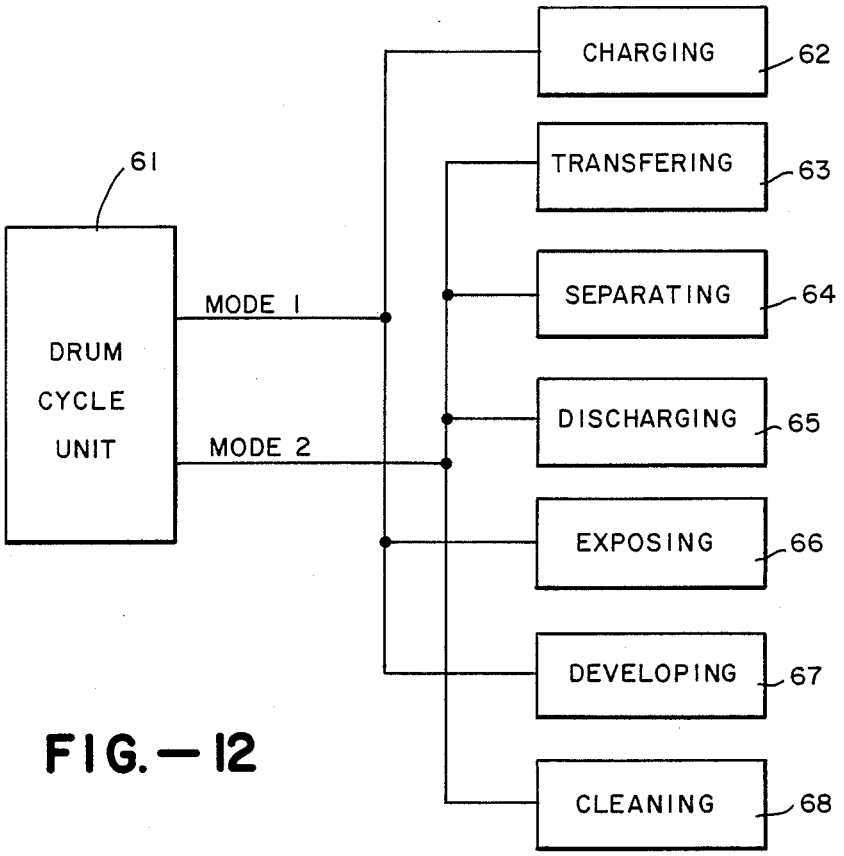
FIG. 12 shows the action cycle relationship of the unit of the present invention.

FIG. 12 is a block diagram showing an example of cycle control for the unit shown in FIG. 10. In FIG. 12, a drum cycle unit 61 is so structured as to selectively introduce an output for activating a charging means 62, a transferring means 63, a separating means 64, a discharging means 65, an exposing means 66, a developing means 67 and a cleaning means 68. In Mode 1, it sequentially outputs control signals for the charging, exposing and developing while in Mode 2, control signals are sequentially outputted to operate the transferring, separating, discharging and cleaning means. In the above, the control signals inputted to the charging means 62 and the transferring means 63 correspond to the signal S mentioned before and operate the unit 40 by selecting one of these two functions according to the mode.

With regard to FIG. 10, the discharging section 47 where the residual charges on the drum 41 are removed after the toner image is transferred should be disposed at least on the downstream side of the discharging unit 40 and on the upstream side of the cleaning means 48 with respect to the motion of the drum 41. If it is so disposed that the discharging section 47 comes before the residual toner is removed by the cleaning means 48, the electrostatic attraction between the toner and the drum 41 is weakened and the cleaning becomes easier. Moreover, since the discharging section 47 is on the downstream side of the corona discharging unit 40 but on the upstream side of the developing means 43, the removal of charges from the drum 41 takes place during the second rotation within each cycle before the drum 41 passes the developing means 43. This can prevent the "redevelopment" by the charges remaining on the drum 41 when it passes the developing means 43. It also reduces the toner consumption and makes the cleaning operation more effective. Furthermore, since the cleaning means 48 is disposed immediately upstream to the corona discharging unit 40, the cleaning operation takes place at the end of each copying cycle. This means that the possibility of dust and toner particles reattaching themselves onto the drum 41 is minimized before the starting of a new copying cycle.

Figure 13:
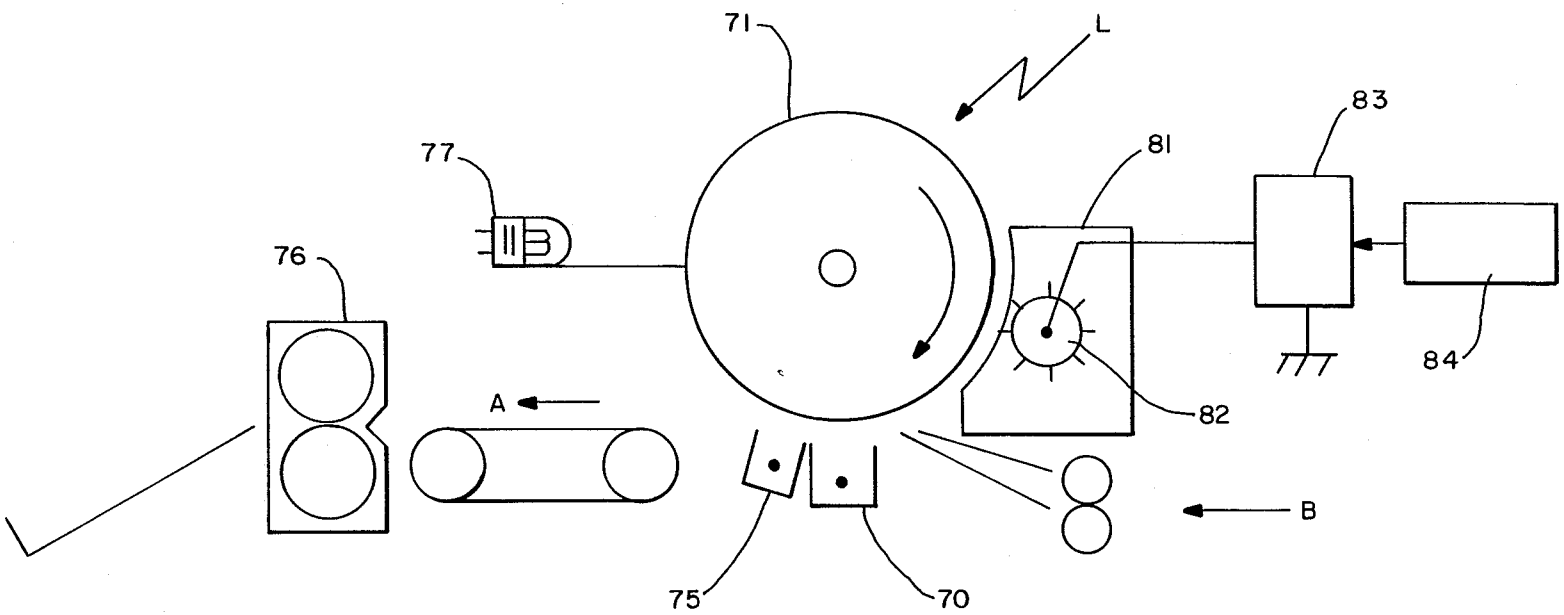
FIG. 13 shows schematically still another example of electrophotographic copying machine according to the present invention.

A still further embodiment of the electrophotographic copying machine of the present invention is schematically shown in FIG. 13. As described above, a photosensitive drum 71 is uniformly charged (positively, for example) by a corona discharging unit 70 provided for both charging and transferring as the first step in Mode 1. The drum 71 continues to rotate, passing another corona discharging unit 75 provided for separating and discharging and then a discharging section 77. The unit 75 and the discharging section 77 are both in an inactive condition at this moment and have no effects on the drum 71. When the drum rotates further and reaches the position for exposure, a light image L of an original is focused on the drum 71 and a latent electrostatic image is formed. Such an image L is obtained as explained above by using an exposing means (not shown) to light-scan the original on a holder means (not shown) synchronously with the rotating drum 41.

Subsequently, the drum 71 with a latent electrostatic image formed thereon reaches a developing-cleaning means 81 which comprises development sleeves 82 for containing therein a dry two-component developing agent which is a mixture of carrier powder (iron powder) and toner particles and applying it on the surface of the drum 71. Connected to the development sleeves 82 is a developing-cleaning bias 83 which is adapted to selectively provide different bias potentials to the development sleeves 82 so that the developing-cleaning means 81 can be made to function either as a developing means or as a cleaning means. This selection is effected by means of a timing control signal from a developing-cleaning bias switching command means 84. When the drum 71 is charged to a light charging level of $V_L$ volt and a dark charging level of $V_D$, for example, a bias potential of $V_B$ volt for development is so chosen that $V_D > V_B > V_L$. The latent electrostatic image formed on the drum 71 is then developed by toner particles which have been negatively charged under an appropriate bias voltage. A toner image of the original is thus formed on the drum 71. The drum continues to turn in the meantime and reaches the corona discharging unit 70 and starts the second rotation in Mode 2.

During the second rotation in Mode 2, the unit 70 functions as a transferring means. Paper moving in the direction of B to A with appropriate timing comes into contact with the drum 71 and the toner image is transferred onto the paper by a corona discharge with positive polarity from the back surface of the paper. The paper is thereafter separated from drum 71 by means of the unit 75 and moves into a fixing section 76.

The drum 71 continues to rotate and the remaining charge is eliminated in the discharging section 77 which is now in an active condition. This discharging process may also be effected by an AC corona discharge or corona discharging of polarity opposite to that of the preliminary charging. When the drum 71 further rotates and reaches the developing-cleaning means 81, the latter is now made to function as a cleaning means with a higher bias applied thereto by the bias power source 83 than the bias potential at the time of development. Thus, the toner particles remaining on the drum 71 are attracted into the development sleeves 82 and collected into the development means. The cycle comes to an end and the system prepares for the beginning of another cycle.

The cleaning process may be so designed that the bias potential will remain fixed if the charges on the drum 71 are eliminated sufficiently in the preceding discharging process and there is no need to switch this bias potential. Alternatively, the bias potential may be lowered at the time of cleaning so as to eliminate or reduce the effect of toners with opposite polarity at the time of cleaning.

According to this example, one cycle for the formation of image includes two rotations. During the first rotation in Mode 1, preliminary charging, exposing and developing are completed while toner image transfer, separation, discharging and cleaning are effected during the second rotation, and the function of preliminary charging during the first rotation and that of toner image transfer during the second rotation are effected by a single corona discharging unit 70 and a single high voltage power source. Moreover, the developing during the first rotation and the cleaning during the second rotation are both effected by a single means 81, and the switching between these two functions is effected either by changing the bias potential applied to the developing sleeves 82 inside the developing means or by a discharge process on the surface of the drum 71 prior to the cleaning process.

The output from the unit 70 is usually higher in the case of preliminary charging than for transferring. For this reason, the discharging unit may be so designed as shown in FIG. 11 so that different values of output can be selected for these processes.

The examples given above are intended to be merely illustrative and this invention is accordingly to be broadly construed. For example, the drum may also be made of ZnO, CdS or organic photoconductive materials. Polarity may be selected differently according to the type of the photosensitive substance. The drum may be formed by wrapping a photosensitive sheet around a base. The photosensitive material in the form of a belt may also be utilized. As for the exposing means, the original may be made movable with the optical system kept stationary or the optical system including lenses and mirrors may be made movable while the original is kept stationary. The present invention is applicable to any device wherein a photosensitive element moves cyclically along a predetermined path with its surface always moving in one direction and where a light image can be exposed in synchronism therewith.

What is claimed is:

1. A corona discharging unit for use in copying machine comprising a shield case having an opening, a corona discharge line disposed inside said shield case, a control grid for controlling polarity and/or output of a corona discharge, said grid being dispersed near said opening of said shield case and divided into segments, a control means connected to said control grid for individually controlling polarity and/or output of said segments of said corona discharge, and a single high voltage AC power source connected to said corona discharge line.

2. The corona discharging unit of claim 1 wherein said control means includes a rectifier adapted to be used for polarity control of said corona discharge.

3. In an electrophotographic copying machine for copying by causing copy paper to contact a photosensitive member on which a toner image is formed and by using a corona discharging means, a corona discharging means which includes a single corona discharging unit with an opening, a control grid for controlling the polarity and/or output of a corona discharge, said grid being disposed near said opening and divided into segments, a single high voltage source, and a control means connected to said control grid to individually control said segments, whereby said corona discharging means can be used selectively for transferring a toner image and for separating said copy paper from said photosensitive member.

4. An electrophotographic copying machine having functions of charging, exposing, developing, transferring, discharging and clearing, comprising a corona discharging unit from a single power source for both charging and transferring, said corona discharging unit being disposed opposite a photosensitive member and adapted to effect charging before an image is formed on said photosensitive member in a first mode of operation thereof and to transfer a toner image formed on said photosensitive member in a second mode of operation thereof, said corona discharging unit including a control grid disposed opposite a corona discharge line for controlling polarity and/or output of a corona discharge, said grid being divided into segments and a means for selectively assigning said corona discharging unit to said first mode or to said second mode during operation of said copying machine and individually controlling said segments.

5. The electrophotographic copying machine of claim 4 wherein said corona discharging unit is so adapted that an output therefrom is controlled according to the timing for selecting the functions of charging and transferred thereof.

6. The electrophotographic copying machine of claim 4 wherein a discharging means for effecting the function of discharging is disposed on the downstream side of said corona discharging unit and on the upstream side of a developing means for effecting the function of developing.

7. The electrophotographic copying machine of claim 4 wherein a cleaning means for effecting the function of cleaning is disposed on the upstream side of said corona discharging unit and on the downstream side of a developing means for effecting the function of developing.

8. The electrophotographic copying machine of claim 4 further comprising a combined means for effecting the functions of both developing and cleaning, said photosensitive member as to be adapted to develop an image on said photosensitive member in said first mode and to clean said photosensitive member in said second mode, and a means for selectively assigning said combined means to said first mode or to said second mode.

* * * * *

UNITED STATES PATENT AND TRADEMARK OFFICE

CERTIFICATE OF CORRECTION

PATENT NO. : 4,835,571

DATED : May 30, 1989

INVENTOR(S) : Takao Tagawa, et al.

It is certified that error appears in the above-identified patent and that said Letters Patent is hereby corrected as shown below:

IN THE CLAIMS:

Claim 1, column 9, line 4, change "dispersed" to --disposed--.

Claim 8, column 10, line 31, after "said" add --combined means being so disposed with respect to said--.

Signed and Sealed this

Thirtieth Day of January, 1990

*Attest:*

JEFFREY M. SAMUELS

*Attesting Officer*

*Acting Commissioner of Patents and Trademarks*